United States Patent [19]

Martens

[11] 4,073,034

[45] Feb. 14, 1978

[54] DOOR-SUPPORTING SYSTEM FOR MULTIPANEL, SIDE-OPENING DOORS

[75] Inventor: Edward W. Martens, Memphis, Tenn.

[73] Assignee: Dover Corporation, Memphis, Tenn.

[21] Appl. No.: 722,729

[22] Filed: Sept. 13, 1976

[51] Int. Cl.[2] ..... E05D 13/02

[52] U.S. Cl. ..... 16/87 B; 16/87 R

[58] Field of Search ..... 16/87 B, 94, 87 R, 91, 16/96, 106, 107; 105/150; 160/196, 197, 202; 104/93; 49/409, 404, 410

[56] References Cited

U.S. PATENT DOCUMENTS

| | | | |
|---|---|---|---|
| 1,073,509 | 9/1913 | Nelson | 16/106 |
| 1,490,190 | 4/1924 | Scott | 49/409 |
| 1,920,855 | 8/1933 | Gloekler | 16/87 B |
| 2,751,637 | 6/1956 | Kraft | 49/409 X |
| 2,893,071 | 7/1959 | Oden | 49/409 X |
| 3,260,303 | 7/1966 | Pipe | 160/197 |
| 3,425,162 | 2/1969 | Halpern | 49/409 |
| 3,426,480 | 2/1969 | Dzamba | 49/410 |
| 3,611,637 | 10/1971 | Saino | 49/410 X |
| 3,975,862 | 8/1976 | Doan | 49/409 |
| 4,004,655 | 1/1977 | Kraft | 49/409 |

FOREIGN PATENT DOCUMENTS

| | | | |
|---|---|---|---|
| 1,237,286 | 6/1960 | France | 160/197 |
| 1,254,505 | 11/1957 | Germany | 160/197 |

*Primary Examiner*—Ronald Feldbaum
*Attorney, Agent, or Firm*—Brumbaugh, Graves, Donohue & Raymond

[57] ABSTRACT

A door-supporting system for a multipanel, side-opening door includes a single track from which each panel is supported.

10 Claims, 5 Drawing Figures

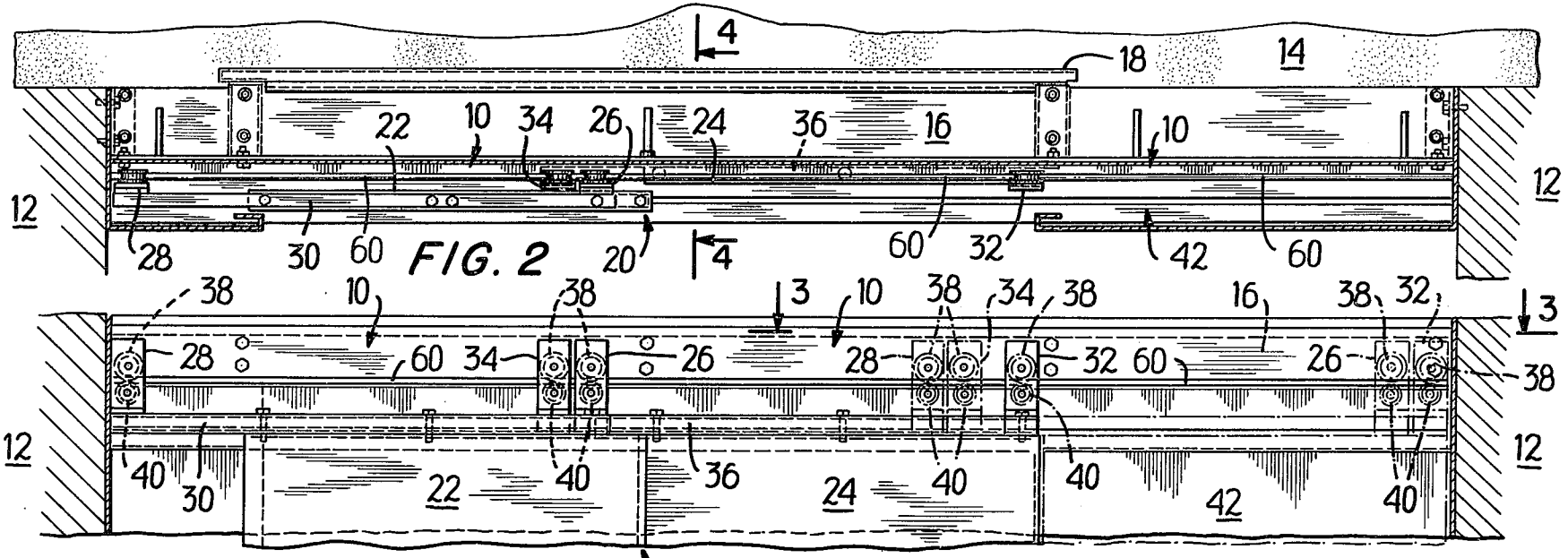
FIG. 2
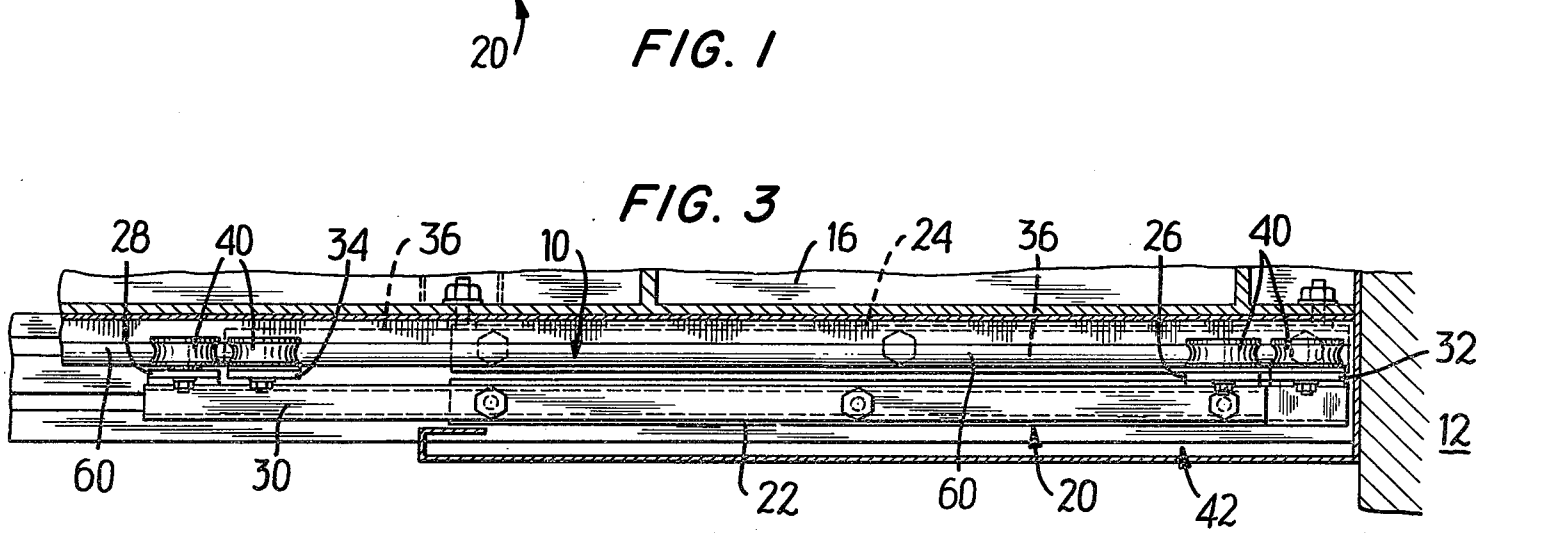
FIG. 1
FIG. 3

DOOR-SUPPORTING SYSTEM FOR MULTIPANEL, SIDE-OPENING DOORS

The present invention relates to a door-supporting system and, more particularly, to a novel and improved door-supporting system for multipanel, side-opening doors.

For many years multipanel, track-supported doors have been used in a number of installations to provide controlled access to an entrance or the like in a wall or similar building structure. In many such installations, access to the entrance is controlled by sliding the door into and out of the entrance. In general, there are two basic types of multipanel, track-supported doors that operate in this manner: center-opening and side-opening.

Conventional center-opening, one-speed doors include a pair of coplanar panels capable of being slid away from one another to open the door and expose the entrance. In the fully open position, the panels are located on opposite sides of the entrance. The door can be closed by sliding the panels toward each other until their leading edges abut one another. Inasmuch as the panels extend across the entrance when the door is closed, access to the entrance is prevented. Because the panels are coplanar, they may be supported from a single track to simplify mounting.

Such center-opening doors suffer, however, from the disadvantage that a door-receiving space is required on both sides of the entrance to receive the panels when the door is open. Furthermore, the combined width of the door-receiving spaces must be not less than the width of the entrance.

Multipanel, side-opening doors overcome this problem by utilizing at least two panels supported for travel in substantially parallel planes. Unlike the panels of center-opening doors, the panels of side-opening doors travel in the same direction to open the door and expose the entrance and in the opposite direction to close the door and obstruct the entrance. When the door is closed, the panels are horizontally staggered across the entrance. In the open position, the panels are aligned one behind the other in a door-receiving space located on one side of the entrance.

Thus the width of the door-receiving space can be less than the width of the entrance. For a two panel, side-opening door, for example, the space required is reduced to approximately one half the width of the entrance. By employing a side-opening door having more than two panels, the width of the door-receiving space can be reduced further.

In one well known hanger arrangement for side-opening doors, each panel is provided with its own individual pair of spaced-apart hanger assemblies positioned along the upper edge of the panel between its side edges. Such a hanger arrangement prevents all the panels from being supported by a common track, because contact between hanger assemblies of adjacent panels prevents proper opening and closing of the door.

In the past, this problem has been overcome by employing multiple tracks, one for each panel of the door. However, the utilization of multiple tracks is undesirable due to increased cost and construction time in purchasing and mounting the tracks. Because the tracks usually extend outwardly from a common header located above the entrance, a cantilever effect is created. The cantilever effect is greatest for the tracks extending furthest from the header. As the cantilever effect increases, the rigidity and strength of the entire door-supporting system decrease.

Because the hanger assemblies are attached to the upper portion of the panels above their center of gravity, the panels have a tendency to swing like a pendulum about the hanger assemblies when the door stops suddenly. In an effort to eliminate this pendulum effect, it is common to provide each hanger assembly with a pair of vertically spaced-apart rollers. One roller is mounted for movement along the top surface of an upper rail of a C-shaped track. The other roller bears against the bottom surface of a lower rail of the C-shaped track. If the distance between the rails increases, the rollers will jam. On the other hand, accidental derailment of the rollers and pendulum-like swinging of the panels will not be alleviated if the distance between the rails decreases. Therefore such a track and roller arrangement is disadvantageous because the distance between the rails of the C-shaped track must be kept relatively constant, requiring precision machining of the track.

In accordance with the present invention, there is provided a novel and improved door-supporting system for a side-opening door which normally includes at least two parallel panels capable of traveling in a first direction to open the door and in a second direction, opposite of the first direction to close the door, each panel traveling a different distance than an adjacent panel during the opening and closing of the door. In accordance with the improvement, means are provided for supporting the panels from a single track, whereby the space-saving advantages of side-opening doors and the mounting advantages of center-opening doors may be utilized simultaneously.

In one embodiment of the supporting means, each panel is provided with its own individual pair of spaced-apart hangers. The hangers are positioned in such a manner than one hanger of each panel travels along the track between the hangers of an adjacent panel during the opening and closing of the door. The distance between the hangers of each pair is not less than the width of the corresponding panel plus the width of the hanger of the adjacent panel positioned between them. This unique hanger arrangement permits the door to open and close properly, without interference caused by contact between the hangers of adjacent panels, even though all the panels are mounted on the same track.

The track itself may have an inverted U-shape. The closed end of the track is engaged by a door roller mounted on each hanger. The door rollers move over and along the closed end of the track. An upthrust roller is also provided on each hanger below the door roller. The upthurst rollers engage the open end of the track for movement in and along the open end of the track. Besides ensuring positive engagement between the door rollers and the track to prevent accidental derailment of the door rollers, the upthrust rollers also alleviate the pendulum effect caused by the sudden stopping of the door. Inasmuch as the door rollers and the upthrust rollers engage opposite sides of the same track, the distance between them may be determined by the gauge of the material from which the track is manufactured. Maintaining a single track at a constant gauge is easier and more economical than maintaining a constant distance between two spaced-apart rails.

The present invention is especially adapted for use in controlling access to an entrance. In the open position of the door, the panels are moved out of the entrance and into a door-receiving space alongside it. By making all the panels one width, they may be aligned one behind the other in the door-receiving space, which need only be as wide as the panels.

To synchronize the movements of the panels into and out of the entrance, they may be designed to travel at speeds proportional to their distance of travel during the opening and closing of the door. Thus the fastest panel would be the one traveling the longest distance and the slowest panel would be the one traveling the shortest distance.

The track may be positioned above the door adjacent the entrance. Mounting the track in this manner diminishes the cantilever effect created when the track extends laterally from the entrance, thereby improving the stability and strength of the entire door-supporting system.

The door-supporting system of the present invention can be used advantageously in combination with an elevator hoistway door of the two-speed, side-opening type. Such hoistway doors normally include a fast panel and a slow panel, which is controlled by the movement of the fast panel through a conventional cable relating device. In the event that the cable relating device becomes inoperable, at least one of the hangers of the fast panel contacts a hanger of the slow panel to move it along the track with the fast panel. The present invention therefore provides a fail-safe system for ensuring the proper closing and opening of the hoistway door, thereby preventing a potentially unsafe condition that would occur if the door were closed or opened improperly to expose an empty hoistway.

For a more complete understanding of the invention, reference may be had to the following detailed description taken in conjunction with the accompanying figures of the drawing, in which:

FIG. 1 is an elevational view, partially cut away, of the door-supporting system of the present invention employed in an elevator installation;

FIG. 2 is a plan view of the door-supporting system shown in FIG. 1;

FIG. 3 is a cross-sectional view, taken along the lines 3—3 in FIG. 1 and looking in the direction of the arrows, of the door-supporting system of FIG. 1;

Figure 4:
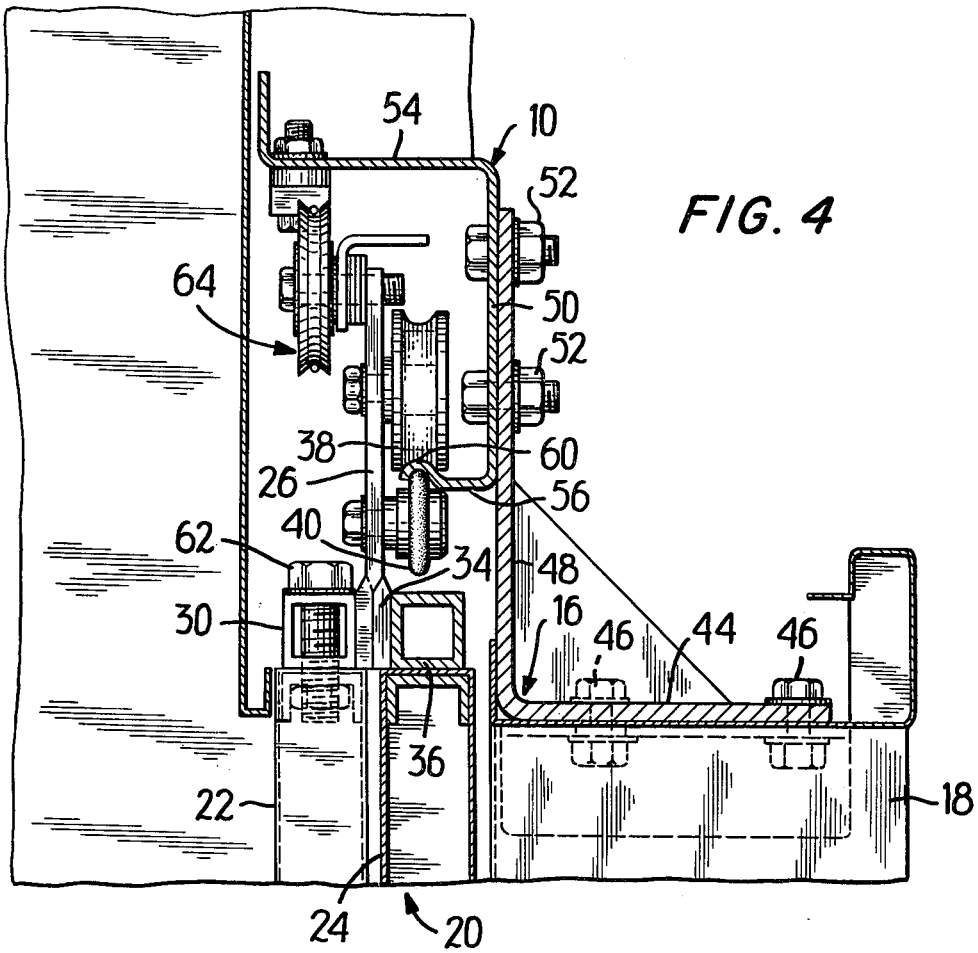
FIG. 4 is a cross-sectional view, taken along the lines 4—4 in FIG. 2 and looking in the direction of the arrows, of the door-supporting system of FIG. 2.

While the invention is applicable to multipanel, side-opening doors designed for various applications, it is especially suitable for hoistway doors employed in elevator installations. Thus the invention will be described with particular reference to an elevator hoistway door.

Referring to FIGS. 1 and 2, the door-supporting system of the present invention includes a header 10 which extends laterally across an elevator hoistway opening defined by opposite side walls 12 of the hoistway and a landing 14. The header 10 is mounted on a header bracket 16 attached at either end to the side walls 12 of the hoistway and supported from below by a door frame 18, which defines a hoistway entrance.

Access to the hoistway through the entrance is controlled by a conventional two-speed, side-opening door 20 having a fast panel 22 and a slow panel 24. The fast panel 22 is supported for horizontal movement along a track 60 of the header 10 by a pair of hangers 26, 28 attached to a bar 30 mounted on the upper edge of the fast panel 22. A similar pair of hangers 32, 34 is attached to a bar 36 mounted on the upper edge of the slow panel 24 to support it for horizontal movement along the track 60. Each hanger includes a door roller 38 and an upthrust roller 40 which roll on opposite sides of the track 60 so that the panels are supported for horizontal movement transversely of the hoistway opening.

In operation, the fast panel 22, which is the same width as the slow panel 24, travels at approximately twice the velocity of the slow panel 24 to synchronize their movement into and out of the entrance. Thus the panels 22, 24 travel relative to one another during the opening and closing of the hoistway door 20. To prevent the hangers from interfering with the opening and closing of the door 20, proper spacing between them must be maintained.

Referring again to FIGS. 1–3, the hanger 32 of the slow panel 24 is positioned substantially adjacent the trailing edge of the panel. The distance between the other hanger 34, which is mounted on the end of the bar 36, and the leading edge of the slow panel 26 must be not less than the width of the hanger 32 of the slow panel 24 plus the width of the hanger 26 of the fast panel 22 mounted between the hangers 32, 34 of the slow panel 24. It follows that the distance between the hangers 32 and 34 of the slow panel 24 is at least equal to the width of the slow panel 24 plus the width of the hanger 26 of the fast panel 22.

The hanger 26 of the fast panel 22 is positioned inwardly from the trailing edge of the fast panel 22 a distance slightly greater than the width of the hanger 32 of the slow panel 24. Thus when the hoistway door 20 is closed (see FIGS. 1 and 2), the hanger 26 of the fast panel 22 occupies a position adjacent the hanger 34 of the slow panel 24. In the open position (see FIG. 3 and the dashed lines in FIG. 1) with the panels 22, 24 aligned one behind the other in a door-receiving space 42, the hanger 26 of the fast panel 22 moves to a position adjacent the hanger 32 of the slow panel 24. The distance between the other hanger 28 of the fast panel 22, which is mounted on the end of the bar 30 extending laterally from the leading edge of the fast panel 22, and the leading edge of the fast panel 22 must be not less than the total width of all the other hangers. Thus the distance between the hangers 26 and 28 of the fast panel 22 is at least equal to the width of the fast panel 22 plus the width of the hanger 34 of the slow panel 24. As the hoistway door 20 moves from a closed to an open position, the hanger 28 of the fast panel 22 moves from a location spaced from the hanger 34 of the slow panel 24 to a location adjacent the hanger 34.

Space is required on the side of the entrance opposite the door-receiving space 42 to receive the hanger 28 of the fast panel 22 when the hoistway door 20 is in the closed position. This space is usually available in most hoistway installations. In any event, the space required is small in comparison to that which must be provided to receive an entire panel of a center-oepning door. If there is insufficient space to accommodate the hanger 28 of the fast panel 22, it may be housed in a pocket provided in the side wall 12 of the hoistway. Also, the relative positions of the hangers with respect to each panel may be varied to reduce the distance between the hanger 28 and the leading edge of the fast panel 22, as long as the relative positions of the hangers with respect to one another are maintained.

Figure 5:
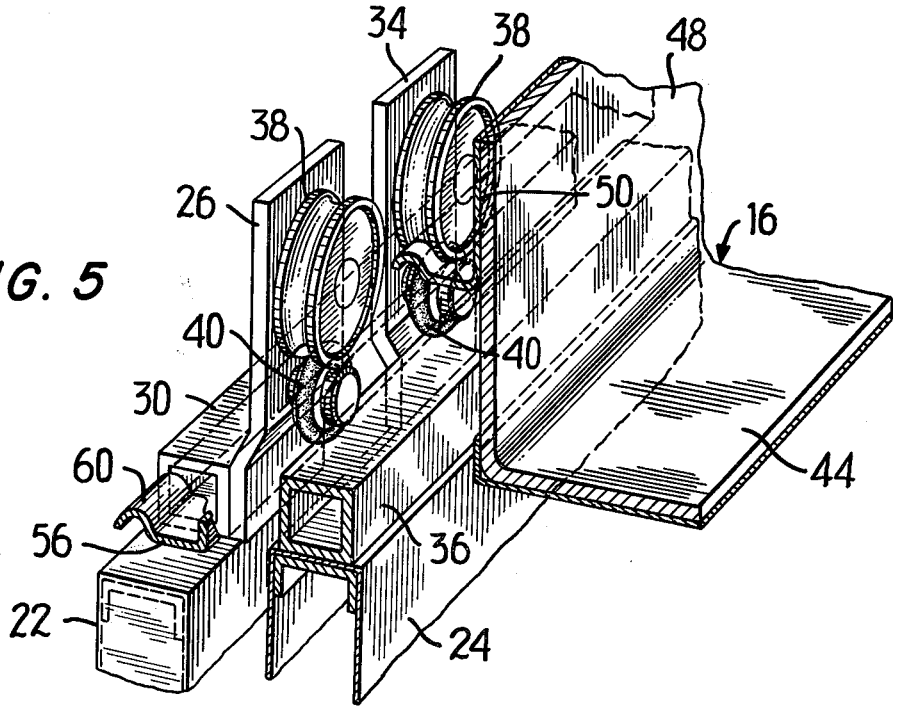
FIG. 5 is a detailed perspective view of the hanger and track arrangement depicted in FIG. 4.

Referring now to FIGS. 4 and 5, the header bracket 16 is L-shaped in cross section having a horizontal leg 44 attached to the top of the door frame 18 by bolts 46.

The other leg 48 of the header bracket 16 extends upwardly from the horizontal leg 44 in approximate vertical alignment with the back edge of the door frame 18.

The header 10 has a cross member 50 mounted flush to the vertical leg 48 of the header bracket 16 by bolts 52. A pair of parallel legs 54, 56 extend laterally from the cross member 50, the upper leg 54 being longer than the lower leg 56. The track 60 is formed at the free end of the lower leg 56 and positioned substantially above the slow panel 24.

Bolts 62 secure the hollow bar 30, having a substantially square cross section, to the upper edge of the fast panel 22. The hollow bar 36 also has a substantially square cross section, and is secured to the upper edge of the slow panel 24 by bolts (not shown in FIGS. 4 and 5). Of course, the bars 30, 36 may be attached to the panels 22, 24, respectively, by any other suitable means.

The hanger 26, as well as the hanger 28 (not shown in FIGS. 4 and 5), of the fast panel 22 has a lower vertical portion which is connected by welding or other suitable means to the front edge of the bar 30 of the fast panel 22. An upper vertical portion of the hangers 26, 28 is offset laterally toward the header 10 in a plane defined substantially by the space between the fast panel 22 and the slow panel 24. The hanger 34, like the hanger 32 (not shown in FIGS. 4 and 5), of the slow panel 24 has a lower vertical portion connected to the rear edge of the bar 36 of the slow panel 24 by welding or otherwise. An upper vertical portion of the hangers 32, 34 is offset laterally away from the header 10 so that it is coplanar with the upper vertical portion of the hangers 26, 28 of the fast panel 22.

The door rollers 38 and the upthrust rollers 40 extend laterally from the upper vertical portion of each hanger, with the door rollers 38 being positioned directly above the upthrust rollers 40. The door rollers 38 and the upthrust rollers 40 are adjustable vertically so that the distance between them can be varied. Vertical adjustment of the rollers also permits the leading edge of each panel to be properly aligned with the sides of the hoistway door frame. The circumferential periphery of the door rollers 38 is concaved to match the outer contour of the track 60 of the header 10 so that the door rollers 38 can roll freely along the track 60 over its closed end. The upthrust rollers 40 have a convexed circumferential periphery which matches the inner contour of the track 60 so that the upthrust rollers 40 can roll freely along the track 60 in its open end. Although the track 60 has been described as having an inverted U-shaped, any other suitable shape or configuration could be used.

The fast panel 22 is driven by a door operator connected to a corresponding panel on an elevator car door. A conventional cable relating device 64 is attached to a hanger of the fast panel 22 for powering the opening and closing of the slow panel 24. In the event that the cable relating device 64 becomes inoperable so that the slow panel 24 is no longer powered by the fast panel 22, the slow panel 24 will still be moved to and from its open and closed positions by the fast panel 22. More specifically, during the opening of the hoistway door 20, the hangers 26, 28 of the fast panel 22 would contact the hangers 32, 34, respectively, of the slow panel 24 to move the slow panel 24 into the door receiving space 42. On the other hand, the slow panel 24 could be moved out of the door-receiving space 42 and into the hoistway entrance by the fast panel 22 through the engagement of the hanger 26 of the fast panel 22 with the hanger 34 of the slow panel 24, as the fast panel 22 moves toward its closed position.

Thus there is provided, in accordance with the invention, a novel and improved door-supporting system for a multi-panel, side-opening door, wherein all the parallel panels are supported from a single track.

It will be understood by those skilled in the art that the above-described embodiment is meant to be merely exemplary and that it is susceptible of modification and variation without departing from the spirit and scope of the invention. For example, the door-supporting system may be utilized in conjunction with a center-opening, two-speed door or a side-opening, three-speed door. Therefore, the invention is not deemed to be limited except as defined in the appended claims.

I claim:

1. In a door-supporting system for a side-opening door, having a multiplicity of individual panels arranged parallel to one another, all the panels being capable of traveling in a first direction to open the door and in a second direction, opposite of the first direction, to close the door, each individual panel traveling a different distance than an adjacent panel during opening and closing of the door, the improvement comprising a single track and means for supporting each panel from said track, said supporting means including a multiplicity of pairs of spaced-apart hangers mounted from said track, each panel having a corresponding pair of said spaced-apart hangers attached thereto, one hanger of each panel being positioned for travel along said track between the hangers of an adjacent panel during opening and closing of the door, the hangers of said corresponding pair of spaced-apart hangers being spaced apart a distance at least equal to the width of the corresponding panel plus the width of the hanger of the adjacent panel positioned therebetween.

2. A door-supporting system according to claim 1, wherein said track has an inverted U-shape; and wherein each hanger includes a first roller engaging the closed end of said track for movement over and along the closed end of said track and a second roller engaging the open end of said track for movement in and along the open end of said track.

3. A door-supporting system according to claim 1, wherein the panels are mounted adjacent an entrance.

4. A door-supporting system according to claim 3, wherein each pair of hangers includes a trailing hanger located nearest the trailing edge of the corresponding panel, the trailing hanger of the panel traveling the shortest distance during opening and closing of the door being positioned substantially adjacent the trailing edge of the shortest traveling panel, the distance between the other hanger of the shortest traveling panel and the leading edge of the shortest traveling panel being not less than the width of the trailing hanger of the shortest traveling panel plus the width of the hanger of the adjacent panel mounted between the hangers of the shortest traveling panel, the trailing hanger of each longer traveling panel being positioned inwardly from the trailing edge of the corresponding panel a distance not less than the total width of all the trailing hangers of each shorter traveling panel; and wherein the panels have substantially the same width so that when the door is open the panels are aligned one behind the other in a door-receiving space located alongside the entrance, the door-receiving space having a width substantially equal to the width of the panels.

5. A door-supporting system according to claim 3, further comprising means for moving the panels at speeds proportional to the distance that they travel during opening and closing of the door so that the panel traveling the longest distance is the fastest panel and the panel traveling the shortest distance is the slowest panel.

6. A door-supporting system according to claim 3, wherein said track is positioned adjacent the entrance above the door.

7. In a door-supporting system for a side-opening door mounted in an elevator hoistway entrance and having a pair of individual panels arranged parallel to one another, both panels being capable of traveling in a first direction to open the door and in a second direction, opposite of the first direction, to close the door, each individual panel traveling a different distance than the other panel during opening and closing of the door, the improvement comprising a single track mounted above the panels adjacent the hoistway entrance; and means for supporting each panel from said track in such a manner that when the door is closed the panels are positioned in the hoistway entrance and when the door is open the panels are positioned out of the hoistway entrance, said supporting means including two pairs of spaced-apart hangers mounted from said track, each panel having a corresponding pair of said spaced-apart hangers attached thereto, one hanger of each panel being positioned for travel along said track between the hangers of the other panel during opening and closing of the door, the hangers of said corresponding pair of spaced-apart hangers being spaced apart a distance at least equal to the width of the corresponding panel plus the width of the hanger of the other panel positioned therebetween.

8. A door-supporting system according to claim 7, wherein said track has an inverted U-shape; and wherein each hanger includes a first roller engaging a closed end of said track for movement over and along said closed end of said track and a second roller engaging an open end of said track for movement in and along said open end of said track.

9. A door-supporting system according to claim 7, further comprising means for moving the panels at speeds proportional to the distance that they travel during opening and closing of the door so that the panel traveling the longest distance is the fast panel and the panel traveling the shortest distance is the slow panel.

10. A door-supporting system according to claim 9, wherein one hanger of the slow panel is positioned substantially adjacent the trailing edge of the slow panel, the distance between the other hanger of the slow panel and the leading edge of the slow panel being no less than the width of the one hanger of the slow panel plus the width of the hanger of the fast panel mounted between the hangers of the slow panel, one hanger of the fast panel being positioned inwardly from the trailing edge of the fast panel a distance not less than the width of the one hanger of the slow panel; and wherein both panels have substantially the same width so that when the door is open the panels are aligned one behind the other in a door-receiving space located alongside the hoistway entrance, the door-receiving space having a width substantially equal to the width of the panels.

* * * * *